US009290006B2

(12) United States Patent
Itagaki

(10) Patent No.: US 9,290,006 B2
(45) Date of Patent: Mar. 22, 2016

(54) IMAGE FORMING APPARATUS FOR MEASURING THE COLOR OF A MEASUREMENT IMAGE

(71) Applicant: CANON KABUSHIKI KAISHA, Tokyo (JP)

(72) Inventor: Tomohisa Itagaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 14/058,659

(22) Filed: Oct. 21, 2013

(65) Prior Publication Data

US 2014/0112672 A1 Apr. 24, 2014

(30) Foreign Application Priority Data

Oct. 23, 2012 (JP) ..... 2012-234025

(51) Int. Cl.
*G03G 15/00* (2006.01)
*B41J 2/21* (2006.01)

(52) U.S. Cl.
CPC ..... *B41J 2/2107* (2013.01); *G03G 15/5062* (2013.01)

(58) Field of Classification Search
CPC ..... G03G 15/5062
USPC ..... 399/15
See application file for complete search history.

(56) References Cited

U.S. PATENT DOCUMENTS

2004/0081477 A1* 4/2004 Maebashi et al. ..... 399/49
2013/0094040 A1* 4/2013 Tomii ..... 358/1.9

FOREIGN PATENT DOCUMENTS

JP 2004-086013 A 3/2004

* cited by examiner

*Primary Examiner* — Walter L Lindsay, Jr.
*Assistant Examiner* — Ruth Labombard
(74) *Attorney, Agent, or Firm* — Canon USA Inc. IP Division

(57) ABSTRACT

An image forming apparatus includes a fixing unit configured to heat and fix a measurement image formed by an image forming unit to a sheet, a measurement unit arranged downstream of the fixing unit in a conveyance direction of the sheet and configured to measure color of the fixed measurement image, a conversion unit configured to convert a measurement result of the measurement unit into a measurement result at a predetermined temperature based on conversion setting information set in advance, a setting unit configured to set a mode for generating the conversion setting information, and a generation unit configured to generate the conversion setting information by causing the image forming unit to form the measurement image on the sheet, causing the fixing unit to fix the formed measurement image, and causing the measurement unit to repeatedly measure the fixed measurement image in response to setting of the mode.

19 Claims, 9 Drawing Sheets

FIG. 8A

| 60°C | | | 25°C ROOM-TEMPERATURE ENVIRONMENT | | |
|---|---|---|---|---|---|
| L | a | b | L | a | b |
| 54.7 | -33.9 | -48.0 | 54.6 | -32.9 | -48.9 |
| 47.1 | 71.4 | -4.4 | 47.9 | 72.0 | -3.3 |
| 91.2 | -5.9 | 94.5 | 91.2 | -6.4 | 94.4 |
| 20.2 | -0.1 | 0.4 | 21.0 | -0.1 | 0.4 |
| 48.4 | 63.2 | 51.8 | 49.1 | 63.4 | 52.2 |
| 49.7 | -62.9 | 33.5 | 49.6 | -62.5 | 33.2 |
| 20.9 | 25.4 | -41.5 | 21.0 | 25.4 | -40.9 |
| ⋮ | ⋮ | ⋮ | ⋮ | ⋮ | ⋮ |

FIG. 8B

| DETECTION TEMPERATURE[°C] | CONVERSION TABLE |
|---|---|
| 80~ | $A_T = 80$ |
| 70~ | $A_T = 70$ |
| 60~ | $A_T = 60$ |
| 50~ | $A_T = 50$ |
| 40~ | $A_T = 40$ |
| 30~ | $A_T = 30$ |

IMAGE FORMING APPARATUS FOR MEASURING THE COLOR OF A MEASUREMENT IMAGE

BACKGROUND OF THE INVENTION

1. Field of the Invention

The present disclosure generally relates to image forming and, more particularly, to an image forming apparatus having a function of measuring the color of a measurement image.

2. Description of the Related Art

An image forming apparatus has image qualities such as granularity, in-plane uniformity, character quality, and color reproducibility (including color stability). With the proliferation of multicolor image forming apparatuses today, the color reproducibility is sometimes said to be the most important image quality.

Humans have memories of empirically expected colors (of skin, blue sky, and metals in particular), and can get an unconformable feeling if the allowable ranges are exceeded. Such colors are called memory colors, reproducibility of which has often been demanded when outputting photographs.

Aside from photographic images, office users may feel unconformable about a color difference of document images from display monitors. Graphic arts users are pursuing color reproducibility of computer graphics (CG) images. The demand for the color reproducibility (including stability) of image forming apparatuses is thus ever increasing.

To meet the users' demand for the color reproducibility, an image forming apparatus that reads measurement images formed on a sheet with color sensors arranged on a sheet conveyance path has been discussed (for example, see Japanese Patent Application Laid-Open No. 2004-086013).

The image forming apparatus forms the measurement images on a sheet, and gives feedback to a process condition such as the amount of exposure and a developing bias based on the reading result of the measurement images by the color sensors. This enables reproduction of a certain density, graduation, and color tone.

However, according to Japanese Patent Application Laid-Open No. 2004-086013, the color sensors are arranged on a conveyance path near a fixing unit. This arouses concern about a phenomenon called "thermochromism," where the measurement images to be measured vary in color with temperature. Such a phenomenon occurs because molecular structures forming color materials such as toner and ink are changed by "heat."

To measure the measurement images inside the image forming apparatus, the color materials need to have been placed on the sheet and the color mixing needs to be completed. If the image forming apparatus uses inks as the color materials, a drying unit needs to heat and dry the measurement images before the measurement. If the image forming apparatus uses toners as the color materials, a fixing unit needs to heat and melt the toners for color mixing before the measurement. The color sensors therefore need to be arranged downstream of the drying unit or fixing unit in the conveyance direction of the sheet.

On the other hand, to constitute the image forming apparatus in a compact configuration, the conveyance path from the drying unit or fixing unit to the color sensors needs to be kept to a minimum necessary length. As a result, the sheet and the color materials heated by the drying unit or fixing unit are conveyed to the color sensors without being cooled to ordinary temperature. Sheet conveyance guides and other internal members of the image forming apparatus and the atmosphere inside also rise in temperature. This also contributes to a sheet temperature higher than ordinary temperature.

As described above, an image forming apparatus including color sensors inside can produce a measurement result different from the color in a normal environment (ordinary temperature environment) because of thermochromism.

SUMMARY OF THE INVENTION

The present disclosure is directed to an image forming apparatus that can suppress the effect of the thermochromism phenomenon where measurement images vary in color with temperature, to measure the color of the measurement images with high accuracy.

According to an aspect of the present disclosure, an image forming apparatus includes an image forming unit configured to form a measurement image on a sheet, a fixing unit configured to heat and fix the measurement image formed by the image forming unit to the sheet, a measurement unit arranged downstream of the fixing unit in a conveyance direction of the sheet and configured to measure color of the measurement image fixed by the fixing unit, a conversion unit configured to convert a measurement result of the measurement unit into a measurement result at a predetermined temperature based on conversion setting information set in advance, a setting unit configured to set a mode for generating the conversion setting information, and a generation unit configured to generate the conversion setting information by causing the image forming unit to form the measurement image on the sheet, causing the fixing unit to fix the formed measurement image, and causing the measurement unit to repeatedly measure the fixed measurement image in response to setting of the mode by the setting unit.

Further features and aspects of the present disclosure will become apparent from the following detailed description of exemplary embodiments with reference to the attached drawings.

BRIEF DESCRIPTION OF THE DRAWINGS

FIG. 8A is a diagram illustrating a direct mapping-based conversion table, and FIG. 8B is a diagram illustrating conversion tables for respective sheet temperatures.

DESCRIPTION OF THE EMBODIMENTS

<Image Forming Apparatus>

In a first exemplary embodiment, a method for solving the foregoing problem will be described by using an electrophotographic laser beam printer. Here, an electrophotographic method is used as an example of the image forming method.

However, exemplary embodiments of the present disclosure are also applicable to an inkjet printing method and a sublimation method. The inkjet printing method uses an image forming unit that forms an image on a sheet by discharging ink and a fixing unit (drying unit) that dries the ink.

Figure 1:
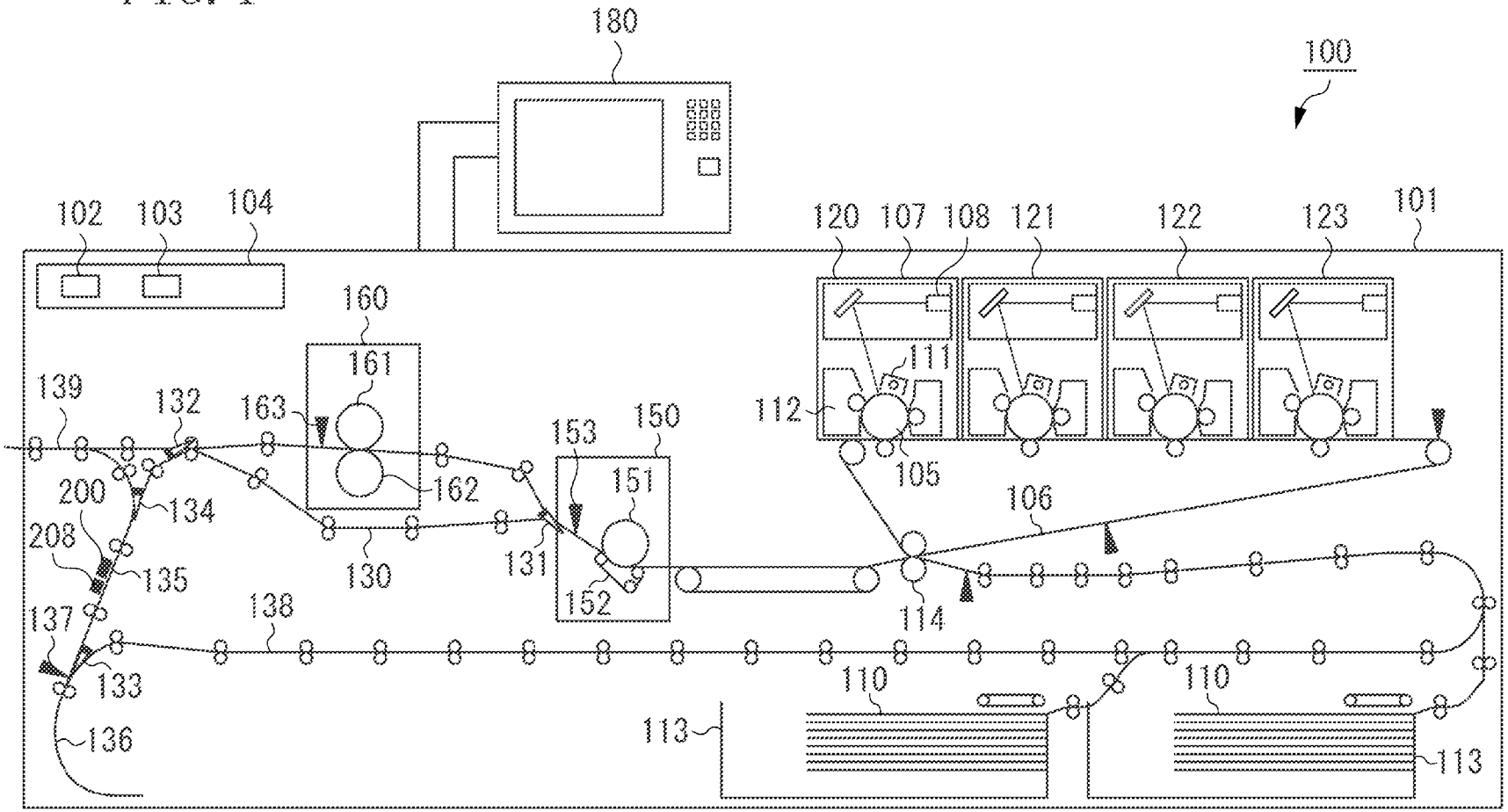
FIG. 1 is a sectional view illustrating a structure of an image forming apparatus 100.

FIG. 1 is a sectional view illustrating a structure of an image forming apparatus 100. The image forming apparatus 100 includes a housing 101. The housing 101 includes mechanisms for constituting an engine unit, and a control board accommodation unit 104. The control board accommodation unit 104 accommodates an engine control unit 102 and a printer controller 103. The engine control unit 102 performs control about printing processes (such as sheet feeding process) of the mechanisms. As used herein, the term "unit" generally refers to any combination of software, firmware, hardware, or other component that is used to effectuate a purpose.

As illustrated in FIG. 1, the engine unit includes four stations 120, 121, 122, and 123 corresponding to yellow (Y), magenta (M), cyan (C), and black (K), respectively. The stations 120, 121, 122, and 123 are image forming units which transfer toner to a sheet 110 to form an image. The stations 120, 121, 122, and 123 generally include common parts. Photosensitive drums 105 are a kind of image bearing member. Primary charging units 111 charge the photosensitive drums 105 with a uniform surface potential. Lasers 108 output laser light, by which latent images are formed on the photosensitive drums 105. Developing units 112 develop the latent images by using color materials (toners) to form toner images. The toner images (visible images) are transferred onto an intermediate transfer member 106. A sheet 110 is conveyed from a paper storage unit 113. Transfer rollers 114 transfer the visible image formed on the intermediate transfer member 106 to the sheet 110.

A fixing processing mechanism according to the present exemplary embodiment includes a first fixing device 150 and a second fixing device 160. The first fixing device 150 applies heat and pressure to the toner images transferred to the sheet 110, thereby fixing the toner images to the sheet 110. The first fixing device 150 includes a fixing roller 151, a pressure belt 152, and a first post-fixing sensor 153. The fixing roller 151 applies heat to the sheet 110. The pressure belt 152 presses the sheet 110 against the fixing roller 151. The first post-fixing sensor 153 detects the completion of fixing. The fixing roller 151 is a hollow roller and includes a heater inside.

The second fixing device 160 is arranged downstream of the first fixing device 150 in a conveyance direction of the sheet 110. The second fixing device 160 adds gloss to the toner image on the sheet 110 fixed by the first fixing device 150 and/or ensures the fixability. Like the first fixing device 150, the second fixing device 160 includes a fixing roller 161, a pressure roller 162, and a second post-fixing sensor 163. Some types of sheets 110 need not be passed through the second fixing device 160. In such a case, the sheets 110 are passed through a conveyance path 130, not the second fixing device 160, for the purpose of reducing energy consumption.

For example, a setting may be made to add a large amount of gloss to a toner image on a sheet 110. Like thick paper, a sheet 110 may need a large amount of heat for fixing. In such cases, the sheet 110 passed through the first fixing device 150 is conveyed to the second fixing device 160. On the other hand, if a sheet 110 is plain paper or thin paper and no setting is made to add a large amount of gloss, the sheet 110 is conveyed through the conveyance path 130 bypassing the second fixing device 160. A flapper 131 is switched to control whether to convey the sheet 110 to the second fixing device 160 or convey the sheet 110 to bypass the second fixing device 160.

A conveyance path switching flapper 132 is a guide member that guides the sheet 110 to either a discharge path 135 or an external discharge path 139. Color sensors 200 and a temperature sensor 208 are arranged downstream of the second fixing device 160 in a conveyance direction of the sheet 110. The color sensors 200 detect measurement images (hereinbelow, referred to as patch images) on the sheet 110. In the present exemplary embodiment, four color sensors 200 are juxtaposed in a direction orthogonal to the conveyance direction of the sheet 110, and can detect four rows of patch images. If an instruction for color detection is given from an operation unit 180, the engine control unit 102 performs a density adjustment, a gradation adjustment, and multiple color correction processing. The temperature sensor 208, serving as a temperature detection unit, is a sensor for detecting the temperature of the sheet 110. For the density adjustment and the gradation adjustment, the color sensors 200 measure the densities of monochromatic measurement images. For a multiple color adjustment, the color sensors 200 measure the densities of measurement images colored by superposing a plurality of colors.

A reversing sensor 137 is arranged on the discharge path 135. A leading edge of the sheet 110 measured by the color sensors 200 is conveyed past the reversing sensor 137 to a reversing unit 136. When the reversing sensor 137 detects a trailing edge of the sheet 110, the conveyance direction of the sheet 110 is switched. A conveyance path switching flapper 133 is a guide member that guides the sheet 110 to either a conveyance path 138 for two-sided image formation or the discharge path 135. A conveyance path switching flapper 134 is a guide member that guides the sheet 110 to the external discharge path 139. The sheet 110 conveyed through the discharge path 139 is discharged to outside the image forming apparatus 100.

<Color Sensor>

Figure 2:
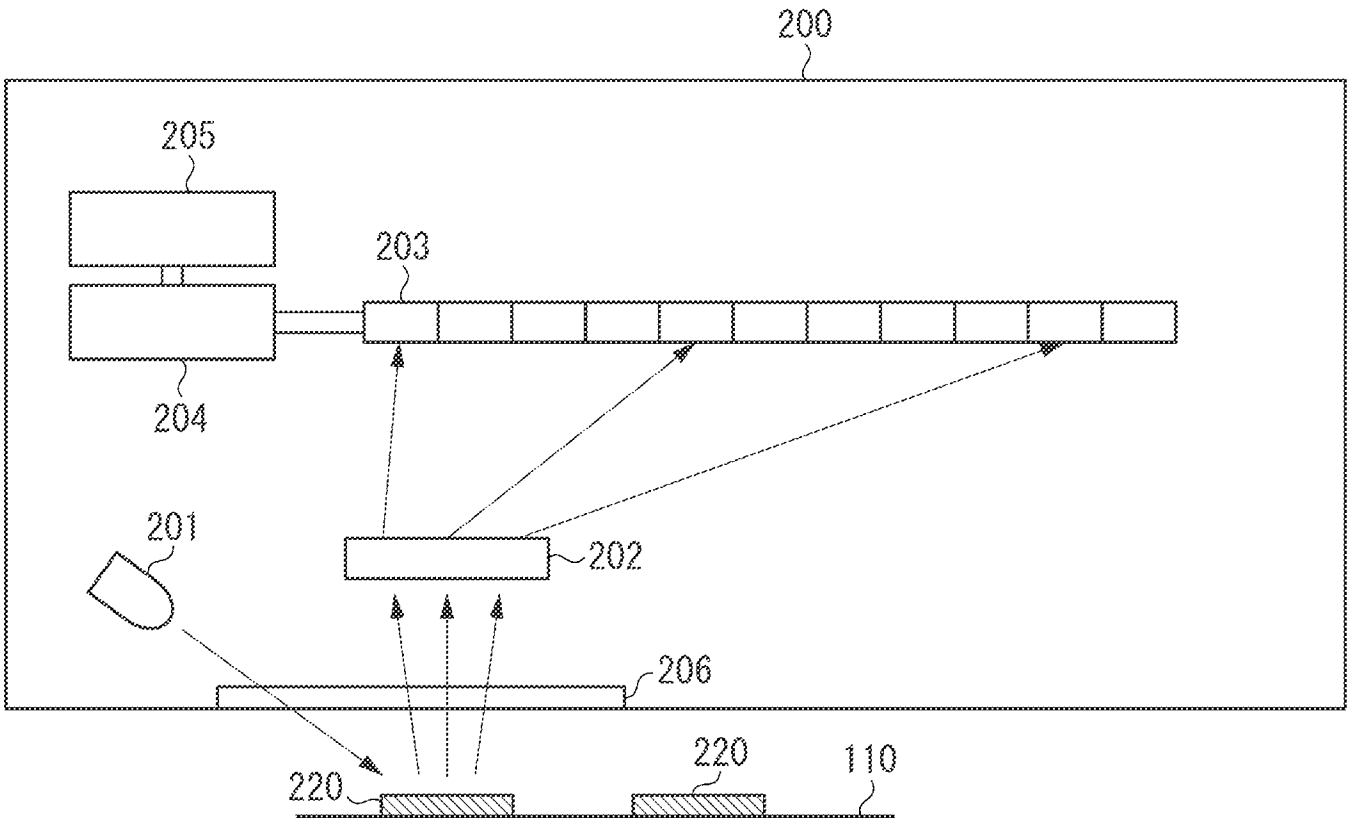
FIG. 2 is a diagram illustrating a structure of a color sensor 200.

FIG. 2 is a diagram illustrating a structure of the color sensor 200. The color sensor 200 each includes a white light-emitting diode (LED) 201, a diffraction grating 202, a line sensor 203, a calculation unit 204, and a memory 205. The white LED 201 is a light emitting element which irradiates a patch image 220 on a sheet 110 with light. The diffraction grating 202 separates the light reflected from the patch image 220 by wavelength. The line sensor 203 is a light detection device including n light receiving elements that detect the light separated by the diffraction grating 202 by wavelength. The calculation unit 204 performs various calculations on the light intensity values of pixels detected by the line sensor 203.

The memory 205 stores various types of data for the calculation unit 204 to use. For example, the calculation unit 204 includes a spectral calculation unit which performs spectral calculations on the light intensity values and a Lab calculation unit which calculates Lab values. The color sensor 200 may further include a lens 206 which condenses the light emitted from the white LED 201 onto a patch image 220 on the sheet 110 and/or condenses the light reflected from the patch image 200 onto the diffraction grating 202.

<Profile>

To perform the multiple color correction processing, the image forming apparatus 100 generates a profile from the detection results of the patch images including multiple colors. Using the profile, the image forming apparatus 100 converts an input image into an output image. The multiple color patch images are patch images formed by superposing a plurality of colors of toners.

International Color Consortium (ICC) profiles have recently been accepted widely in the market. The present exemplary embodiment uses an ICC profile as a profile for providing excellent color reproducibility. However, the present disclosure is not inapplicable without an ICC profile. Exemplary embodiments of the present disclosure may be applied to a color rendering dictionary (CRD) which has been employed for level 2 and above of PostScript proposed by Adobe Systems, Inc., and a color separation table in Photoshop™.

When a customer engineer replaces parts, before the image forming apparatus 100 performs a job that needs high color matching accuracy, or when a user wants to know the color of a final output product at the design stage, the user operates the operation unit 180 to issue an instruction for processing for generating a color profile.

Figure 3:
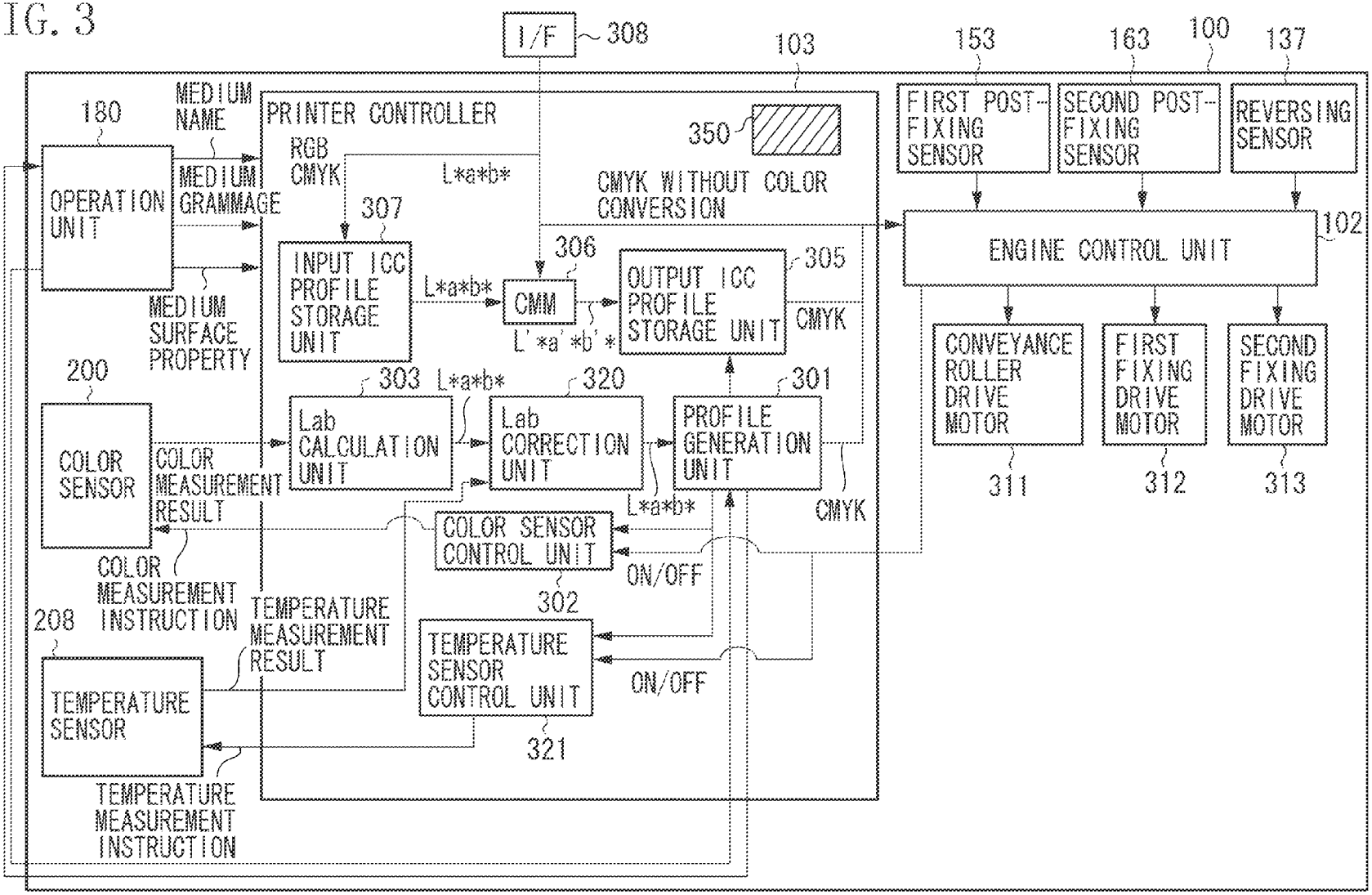
FIG. 3 is a block diagram illustrating a system configuration of the image forming apparatus 100.

The processing for generating a color profile is performed by the printer controller 103 illustrated in the block diagram of FIG. 3. The printer controller 103 includes a central processing unit (CPU). The CPU reads a program for performing a flowchart to be described below from a storage unit 350 and executes the program. For easy understanding of the processing performed by the printer controller 103, FIG. 3 illustrates the interior of the printer controller 103 by using blocks.

When the operation unit 180 accepts a profile generation instruction from the user, the operation unit 180 issues an instruction to generate a profile to a profile generation unit 301. Based on the instruction, the profile generation unit 301 outputs data expressing a CMYK color chart that is an International Organization for Standardization (ISO) 12642 test form to the engine control unit 102 not via a profile. The profile generation unit 301 transmits a measurement instruction to a color sensor control unit 302. The engine control unit 102 controls the image forming apparatus 100 to perform processes such as charging, exposure, development, transfer, and fixing. As a result, an ISO 12642 test form is formed on a sheet 110.

The engine control unit 102 controls a conveyance roller drive motor 311. The conveyance roller drive motor 311 drives conveyance rollers for conveying the sheet 110. The engine control unit 102 further controls a first fixing drive motor 312 for driving the first fixing device 150 and a second fixing drive motor 313 for driving the second fixing device 160.

The color sensor control unit 302 controls the color sensors 200 to measure the ISO 12642 test form. The color sensors 200 output spectral reflectance data that is the measurement result to a Lab calculation unit 303 of the printer controller 103. The Lab calculation unit 303 converts the spectral reflectance data into color value data (L*a*b* data) and outputs the L*a*b* data to a Lab correction unit 320.

A temperature sensor control unit 321 controls the temperature sensor 208 to detect the temperature of the sheet 110 according to an ON/OFF signal from the engine control unit 102. The Lab correction unit 320 corrects the L*a*b* data received from the Lab calculation unit 303 according to the detection result of the temperature sensor 208, and outputs the corrected L*a*b* data to the profile generation unit 301. The Lab calculation unit 303 may convert the spectral reflectance data into an International Commission on Illumination (CIE) 1931 XYZ color system which uses device-independent color space signals.

The profile generation unit 301 generates an output ICC profile from the relationship between the CMYK color signals (data) output to the engine control unit 102 and the L*a*b* data input from the Lab calculation unit 303. The profile generation unit 301 stores the generated output ICC profile in an output ICC profile storage unit 305.

The ISO 12642 test form includes patches of CMYK color signals covering a color reproduction range that can be output by a typical copying machine. The profile generation unit 301 generates a color conversion table from the relationship between the color signal values and the measured L*a*b* values. In other words, the profile generation unit 301 generates a CMYK-to-Lab conversion table. Based on the conversion table, the profile generation unit 301 generates an inverse conversion table.

Accepting a profile generation instruction from a host computer through an interface (I/F) 308, the profile generation unit 301 outputs the generated output ICC profile to the host computer through the I/F 308. The host computer can performs color conversion corresponding to the ICC profile on an application program or programs.

Color Conversion Processing

In color conversion for ordinary color output, an image signal assuming RGB (red, green, blue) signal values or Japan Color or other standard printing CMYK signal values may be input from a scanner unit via the I/F 308. Such an image signal is transmitted to an input ICC profile storage unit 307 intended for external input. The input ICC profile storage unit 307 performs an RGB-to-L*a*b* or CMYK-to-L*a*b* conversion according to the image signal input from the I/F 308. The input ICC profile storage unit 307 stores an input ICC profile including a plurality of lookup tables (LUTs).

Examples of the LUTs include a one-dimensional LUT for controlling a gamma of the input signal, a multiple color LUT called direct mapping, and a one-dimensional LUT for controlling the gamma of generated conversion data. Using such LUTs, the input image signal is converted from a device-depended color space into device-independent L*a*b* data.

The image data converted into L*a*b*coordinates is input to a color management module (CMM) 306. The CMM 306 performs various color conversions. For example, the CMM 306 performs a gamut conversion to map mismatches between a reading color space of the scanner unit serving as an input device and an output color reproduction range of the image forming apparatus 100 serving as an output device. The CMM 306 further performs color conversion to adjust a mismatch between the type of the light source at the time of input and the type of the light source when observing the output product (also referred to as a mismatch between color temperature settings).

In such a manner, the CMM 306 converts the L*a*b* data into L'*a'*b'* data, and outputs the L'*a'*b'* data to the output ICC profile storage unit 305. The output ICC profile storage unit 305 contains the ICC profile generated by measurement. By using the generated new ICC profile, the output ICC profile storage unit 305 performs color conversion to convert the L'*a'*b'* data into CMYK signals dependent on the output device, and outputs the CMYK signals to the engine control unit 102.

Figure 4:
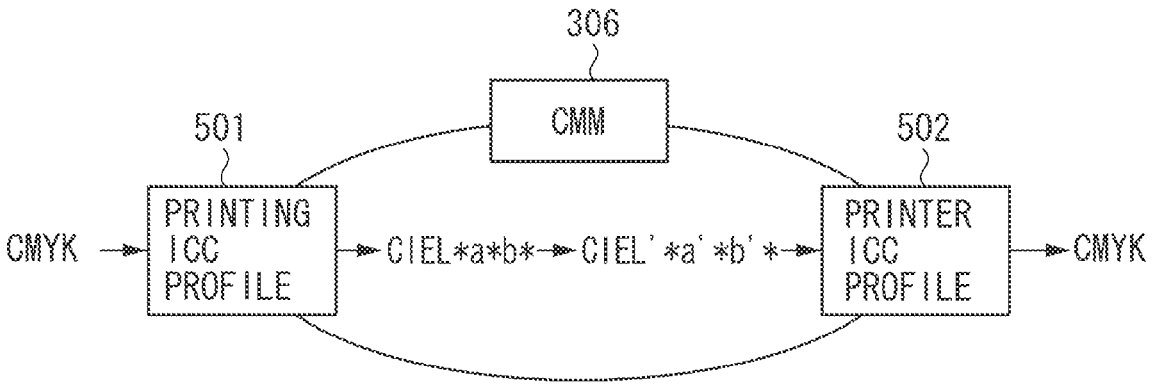
FIG. 4 is a schematic diagram illustrating a color management environment.

In FIG. 3, the CMM 306 is separated into the input ICC profile storage unit 307 and the output ICC profile storage unit 305. In fact, as illustrated in FIG. 4, the CMM 306 refers to a module that is in charge of color management. The module performs color conversion by using an input profile (printing ICC profile 501) and an output profile (printer ICC profile 502).

Color Characteristics of Thermochromism

Figure 5:
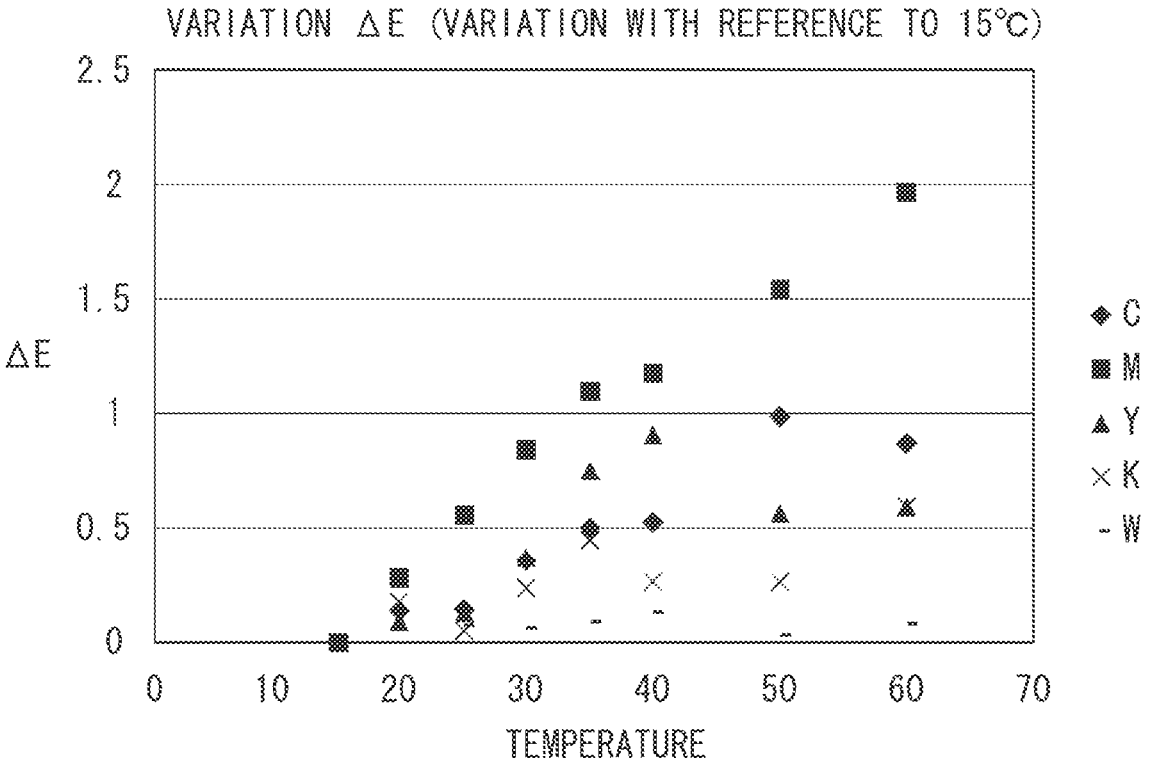
FIG. 5 is a chart illustrating a tendency of color variations of respective color materials.

Next, thermochromism characteristics of respective colors will be described. When molecular structures forming a color material such as toner and ink are thermally changed, the molecular structures vary in color due to a change in the light reflection and absorption characteristics. FIG. 5 illustrates the results of an experiment that was performed to examine the color variations. As illustrated in FIG. 5, the color materials were found to have different tendencies of color variation. The horizontal axis of FIG. 5 indicates the temperature of the patch image. The vertical axis indicates a variation ΔE with reference to 15° C.

ΔE can be expressed by a three-dimensional distance between two points (L1,a1,b1) and (L2,a2,b2) in the L*a*B* color space defined by CIE. The three-dimensional distance is given by the following equation:

$$\Delta E=\sqrt{(L1-L2)^2+(a1-a2)^2+(b1-b2)^2} \quad (1)$$

In FIG. 5, C represents 100% cyan, M 100% magenta, Y 100% yellow, K 100% black, and W paper white. As illustrated in the chart, magenta has particularly poor thermochromism characteristics.

<Thermochromism Compatible Technique>

As an index of color matching accuracy and color stability, the color matching accuracy standard described in ISO 12647-7 (IT8.7/4 (ISO 12642:1617 patch) [4.2.2]) specifies average ΔE of 4.0. According to the reproducibility [4.2.3] (i.e., the stability standard), each patch is specified to have ΔE≤1.5. To satisfy such a condition, the color sensors 200 desirably have a detection accuracy of ΔE≤1.0.

In the present exemplary embodiment, when the color sensors 200 measure patch images heated by the fixing device(s), the printer controller 103 corrects the color values output from the color sensors 200 to calculate color values in an ordinary temperature environment. Even if the patch images vary in color due to thermochromism, the color values of the patch images can thus be detected with high accuracy. Processing for that purpose is described in detail below.

Figure 6:
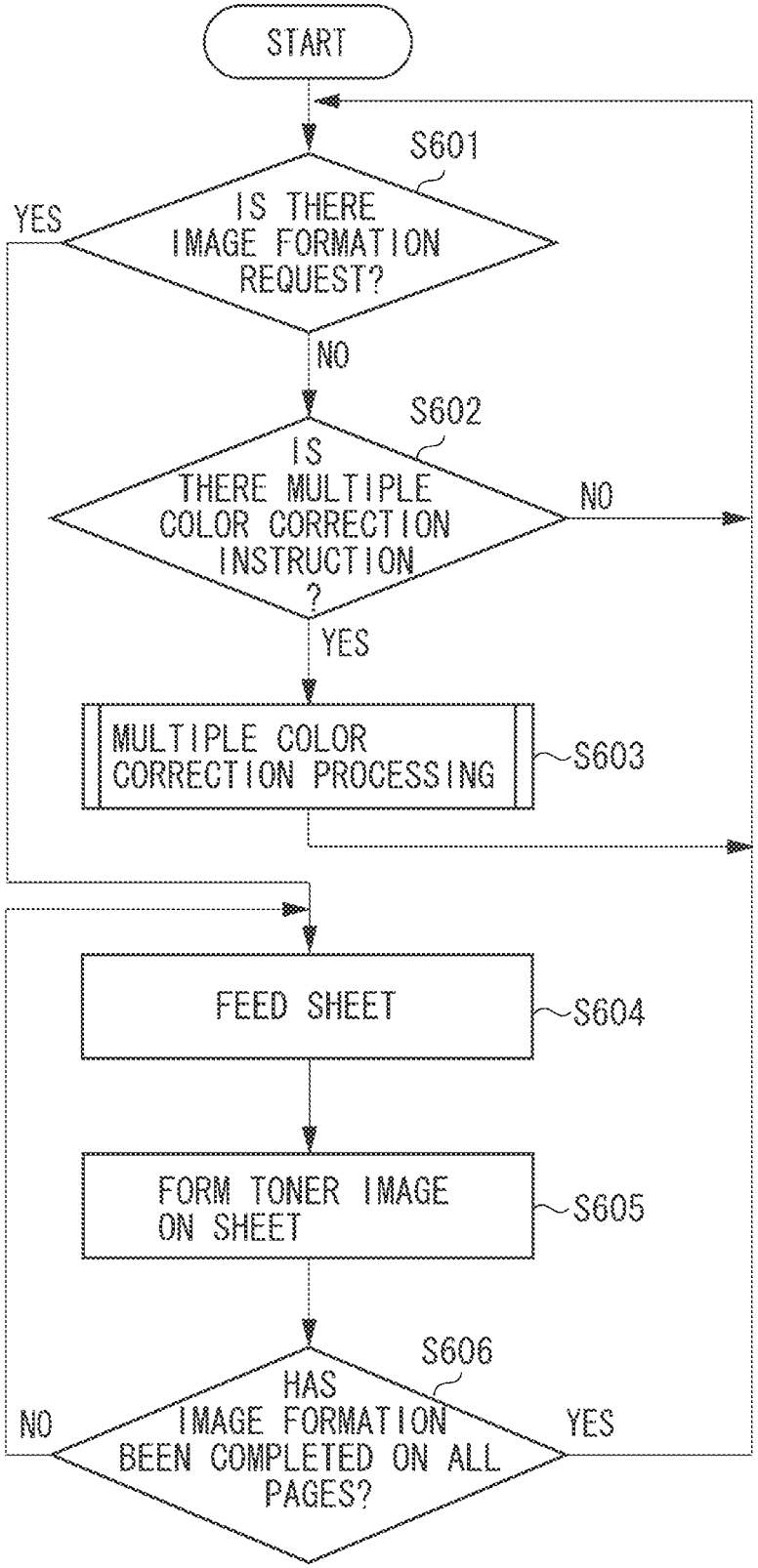
FIG. 6 is a flowchart illustrating an operation of the image forming apparatus 100.

FIG. 6 is a flowchart illustrating an operation of the image forming apparatus 100. The flowchart is performed by the printer controller 103. In step S601, the printer controller 103 determines whether there is an image formation request from the operation unit 180 and whether there is an image formation request from the host computer via the I/F 308.

If there is no image formation request (NO in step S601), then in step S602, the printer controller 103 determines whether there is a multiple color correction instruction from the operation unit 180. If there is a multiple color correction instruction (YES in step S602), then in step S603, the printer controller 103 performs the multiple color correction processing. The multiple color correction processing will be described below with reference to FIG. 7. If there is no multiple color correction instruction (NO in step S602), the printer controller 103 returns to step S601.

If, in step S601, it is determined that there is an image formation request (YES in step S601), then in step S604, the printer controller 103 causes the image forming apparatus 100 to feed a sheet 110 from the paper storage unit 113. In step S605, the image forming apparatus 100 forms a toner image on the sheet 110. In step S606, the printer controller 103 determines whether the image formation has been completed on all the pages. If the image formation has been completed on all the pages (YES in step S606), the printer controller 103 returns to step S601. If the image formation has not been completed on all the pages (NO in step S606), the printer controller 103 returns to step S604 to form an image on the next page.

Figure 7:
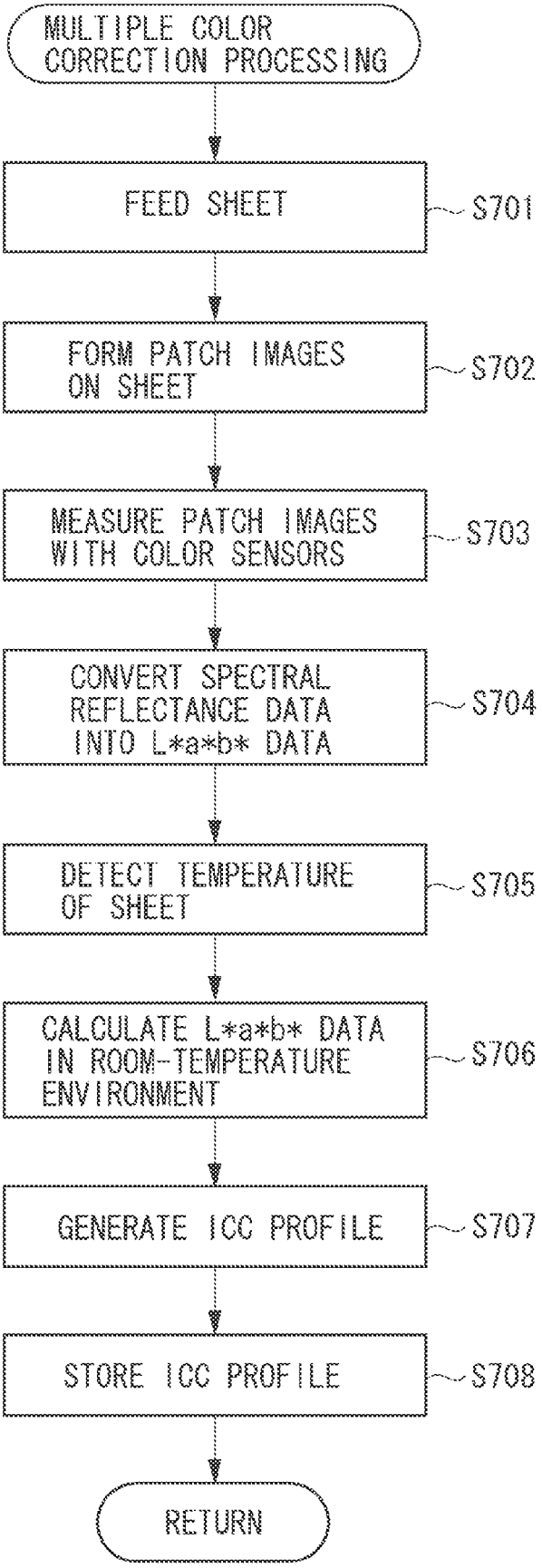
FIG. 7 is a flowchart illustrating multiple color correction processing.

FIG. 7 is a flowchart illustrating multiple color correction processing. The flowchart is performed by the printer controller 103. In step S701, the printer controller 103 causes the image forming apparatus 100 to feed a sheet 110 from the paper storage unit 113. In step S702, the image forming apparatus 100 forms the patch images on the sheet 110. If the sheet 110 has reached the color sensors 200, then in step S703, the printer controller 103 causes the color sensors 200 to measure the patch images. The color sensors 200 output spectral reflectance data on the patch images to the printer controller 103.

In step S704, the printer controller 103 converts the spectral reflectance data into color value data (L*a*b* data). In step S705, the printer controller 103 causes the temperature sensor 208 to detect the temperature T of the sheet 110. In step S706, the printer controller 103 calculates the L*a*b* data in the ordinary temperature environment by using the L*a*b* data converted in step S704 and the temperature T of the sheet 110 detected in step S705. The calculation method will be described in detail below. In the present exemplary embodiment, the ordinary temperature environment is set at a predetermined temperature (25° C.).

In step S707, the printer controller 103 generates an ICC profile by the foregoing processing based on the L*a*b* data calculated in step S706. In step S708, the printer controller 103 stores the ICC profile in the output ICC profile storage unit 305. The processing then returns to the foregoing step S601.

FIG. 8A illustrates a direct mapping-based conversion table of L*a*b* data from 60° C. to 25° C. (ordinary temperature environment). FIG. 8B illustrates a conversion table for respective sheet temperatures. The processing performed in step S706 will be specifically described with reference to FIGS. 8A and 8B.

The sheet 110 having just passed through the fixing device(s) has a high temperature due to the heat given by the fixing device(s). In such a state, the color sensors 200 detect the patch images, and the Lab calculation unit 303 calculates the L*a*b* data from the detection result.

Suppose that the sheet 110 has a temperature of 60° C. when the patch images are detected by the color sensors 200. In such a case, the L*a*b* data calculated by the Lab calculation unit 303 at 60° C. includes errors with respect to the L*a*b* data at 25° C., the ordinary temperature environment.

The Lab correction unit 320 then corrects the L*a*b* data by using the detection temperature T of the temperature sensor 208 to calculate the L*a*b* data in the ordinary temperature environment. Specifically, the Lab correction unit 320 corrects the L*a*b* data by using a direct mapping-based conversion table for converting the Lab color space at 60° C. into the Lab color space in the ordinary temperature environment (25° C.) as illustrated in FIG. 8A.

As illustrated in FIG. 8B, the conversion table has been determined for respective ranges of the detection temperature T of the temperature sensor 208. The specific method for generating the conversion table will be described below. The conversion table illustrated in FIG. 8A is the conversion table $A_{T-60}$. Such conversion tables are stored in the storage unit 350. According to the detection result of the temperature sensor 208, the Lab correction unit 320 reads a conversion table corresponding to the detection temperature T and uses the conversion table for correction.

While the present exemplary embodiment deals with the direct mapping-based conversion method using conversion tables as conversion setting information, the conversion method is not limited thereto. For example, conversion matrices used for a typical color space correction method may be used as the conversion setting information.

In step S705 in the present exemplary embodiment, the temperature T of the sheet 110 is detected by using the temperature sensor 208. However, the image forming apparatus 100 need not necessarily include the temperature sensor 208.

In such a case, the printer controller 103 may calculate the temperature from various conditions for performing an image forming operation.

Specifically, the printer controller 103 calculates the temperature of the sheet 110 at the time of color detection based on the type of the sheet 110 and a fixing mode which are input from the operation unit 180. Possible fixing modes include a normal mode using only the first fixing device 150 and a gloss mode using both the first fixing device 150 and the second fixing device 160. The printer controller 103 refers to a temperature calculation table set in advance and calculates the temperature. Table 1 illustrates the temperature calculation table, which is stored in the storage unit 350 in advance.

TABLE 1

| | | Thin paper | Plain paper | Thick paper 1 | Thick paper 2 |
|---|---|---|---|---|---|
| Fixing mode | Normal mode | 45° C. | 50° C. | 62° C. | 72° C. |
| | Gloss mode | 47° C. | 55° C. | 65° C. | 75° C. |

The fixing modes will be described. The normal mode uses only the first fixing device 150. The gloss mode uses both the first fixing device 150 and the second fixing device 160 for a fixing operation. The sheet 110 thus has a higher temperature in the gloss mode. The temperatures of the fixing devices 150 and 160 for thick papers are set to be higher than for thin paper. The thick papers retain a greater amount of heat, and thus the thick papers are higher than the thin paper in temperature.

Based on the calculation of the temperature of the sheet 110, the Lab correction unit 320 can correct the L*a*b* data to reduce the thermochromism effect.

<Generation of Conversion Tables>

In the present exemplary embodiment, the printer control 103 converts the L*a*b data actually measured by the color sensors 200 into the L*a*b* in the ordinary temperature environment by using the conversion tables illustrated in FIGS. 8A and 8B.

The color sensors 200 may have individual difference. Various paper types also need to be taken into consideration. Thus, setting the relationship between the temperatures and the color values thus has only a limited accuracy. Therefore, in the present exemplary embodiment, the relationship between the temperatures and the color values (L*a*b* data) is actually measured to generate conversion tables for improved accuracy.

Figure 9:
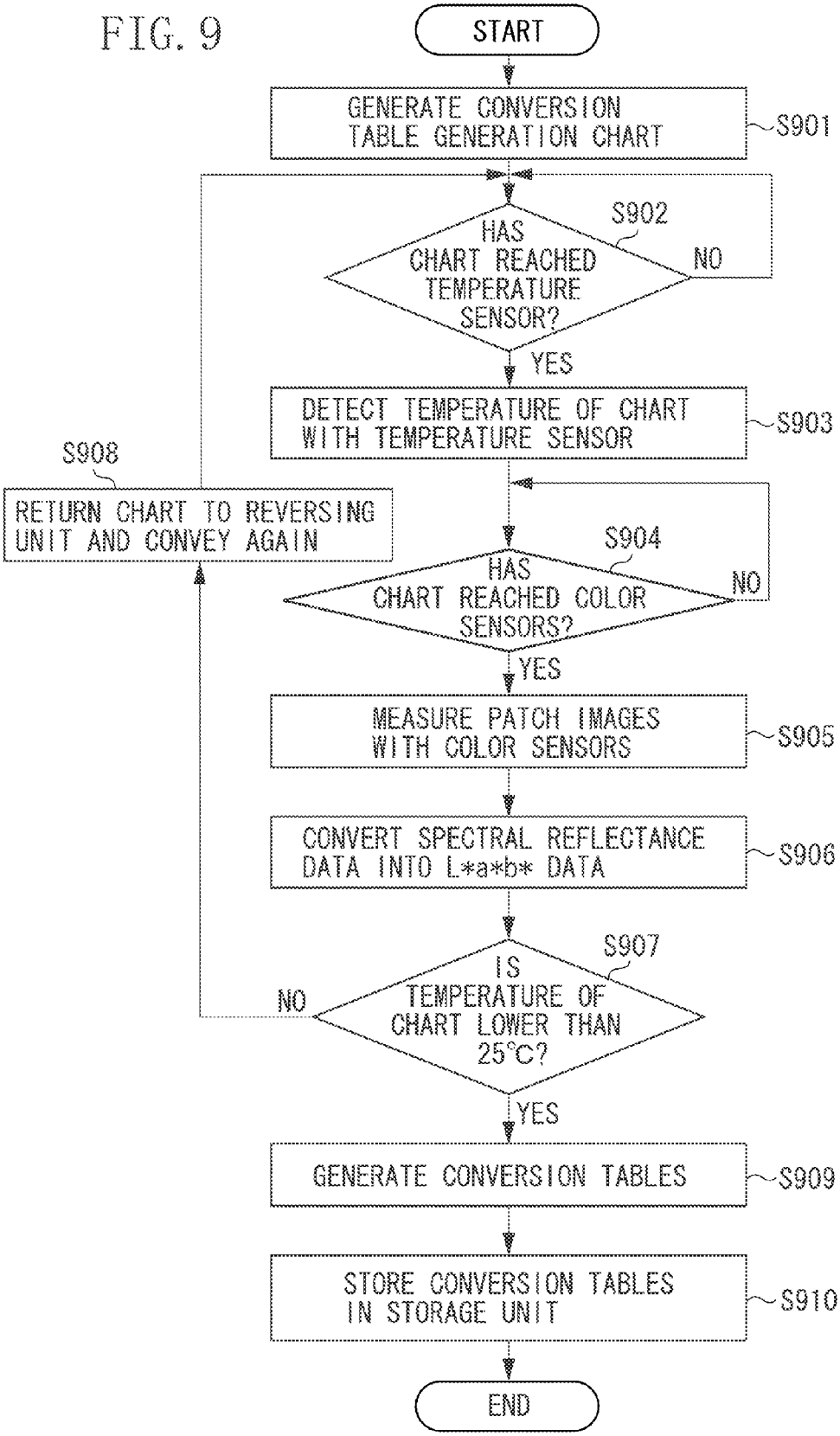
FIG. 9 is a flowchart illustrating processing for generating conversion tables.

FIG. 9 is a flowchart illustrating processing for generating the conversion tables illustrated in FIGS. 8A and 8B. The flowchart is performed by the printer controller 103 based on the setting of a conversion table generation mode from the operation unit 180. The engine control unit 102 controls the image forming apparatus 100 based on instructions from the printer controller 103.

In step S901, the printer controller 103 feeds a sheet 110 from the paper storage unit 113 and forms a plurality of multiple color patch images on the sheet 110 to generate a conversion table generation chart (hereinbelow, referred to simply as a chart). The formed multiple color patch images include patch images in 16 levels (Y)×16 levels (M)×16 levels (C)=4096 colors. The generated chart is conveyed to the reversing unit 136 before reversed in the traveling direction and conveyed toward the temperature sensor 208 and the color sensors 200.

In step S902, the printer controller 103 waits until the chart reaches the temperature sensor 208. The printer controller 103 determines whether the chart has reached the temperature sensor 208 by measuring the time elapsed since the reversing sensor 137 detected the chart. If it is determined that the chart has reached the temperature sensor 208 (YES in step S902), then in step S903, the printer controller 103 causes the temperature sensor 208 to detect the temperature of the chart.

In step S904, the printer controller 103 waits until the chart reaches the color sensors 200. The printer controller 103 similarly determines whether the chart has reached the color sensors 200 by measuring the time elapsed since the reversing sensor 137 has detected the chart. If it is determined that the chart has reached the color sensors 200 (YES in step S904), then in step S905, the printer controller 103 causes the color sensors 200 to measure the patch images on the chart.

In step S905, the color sensors 200 output spectral reflectance data on the patch images to the printer controller 103. In step S906, the printer controller 103 converts the spectral reflectance data into color value data (L*a*b* data).

In step S907, the printer controller 103 determines whether the temperature of the chart measured in step S903 is lower than 25° C. If the temperature of the patch image is higher than or equal to 25° C. (NO in step S907), then in step S908, the printer controller 103 returns the chart to the reversing unit 136 and conveys the chart toward the temperature sensor 208 and the color sensors 200 again.

The processing then proceeds to step S902 to measure the patch images at a temperature lower than that in the previous measurement. In such a manner, the reversal conveyance, temperature measurement, and color value measurement are repeated to dissipate (cool) the heat of the chart and lower the temperature. The printer controller 103 repeats such operations until the chart falls below 25° C., whereby the relationship between the temperatures and the color values of the same chart is actually measured.

If, in step S907, it is determined that the temperature of the chart is lower than 25° C. (YES in step S907), then in step S909, the printer controller 103 generates the conversion tables illustrated in FIGS. 8A and 8B from the L*a*b* data measured at respective temperatures. Specifically, the L*a*b* data of the patch images measured corresponds to the left half of the conversion table illustrated in FIG. 8A. The L*a*b* data of the patch images in the ordinary temperature environment, i.e., the L*a*b* data listed in the right half of the conversion table of FIG. 8A is the L*a*b* data last measured in step S906.

As illustrated in FIG. 8B, the printer controller 103 generates the conversion tables for the respective temperatures measured by the temperature sensor 208. In the example illustrated in FIG. 8B, the conversion tables are generated at intervals of 10° C. However, the conversion tables generated by actual measurements are not necessarily at such regular intervals. In such a case, the detection temperatures in the left field of FIG. 8B may be appropriately modified based on the measured temperatures. In step S910, the printer controller 103 stores the generated conversion tables in the storage unit 350. The printer controller 103 then ends the processing.

As described above, the printer controller 103 generates the conversion tables for converting the L*a*b data measured from the patch images at higher temperatures in the ordinary temperature environment into the L*a*b* data in the ordinary temperature environment. This can suppress the effect of the thermochromism phenomenon with high accuracy.

In the first exemplary embodiment, the printer controller 103 generates the conversion tables based on actual measurements, and corrects the color values measured by the color sensors 200. When generating the conversion tables, the printer controller 103 repeats measuring the color values of the patch images until the temperature of the chart falls below 25° C. However, if the initially measured temperature of the chart is not high at that time, the printer controller 103 cannot generate conversion tables for a wide temperature range as illustrated in FIG. 8B.

When the image forming apparatus 100 is powered on after having been left idle for several hours, the guide members constituting the conveyance paths are often cold. The cold guide members can make contact with the heated and fixed chart to lower the temperature of the chart.

The image forming apparatus 100 was actually left idle for seven hours or more before powered on. The temperature of the chart rose only up to 50° C. If conversion tables are generated in such an environment based on the actual measurements like the first exemplary embodiment, the generated conversion tables can only cover the range of 25° C. to 50° C. It will be understood that high accuracy is obtained only within the range. At temperatures above 50° C., the color values of the patch images cannot be measured with high accuracy.

The instruction to generate an ICC profile, i.e., the instruction for the multiple color correction processing may be given any time at any temperature. The conversion tables are therefore desirably generated to cover a wide temperature range.

In a second exemplary embodiment, the conveyance paths from the fixing devices 150 and 160 to the color sensors 200 are preheated before the output of the conversion tale generation chart. Specifically, sheets 110 fed from the paper storage unit 113 are heated by the first and second fixing devices 150 and 160 and conveyed through the conveyance paths to the color sensors 200 to warm the conveyance paths. This can increase the temperature of the conveyance paths before the measurement of the patch images by the color sensors 200 as compared to when the image forming apparatus 100 is powered on. As a result, the temperature range at the time of generating the conversion tables can be widened.

In the present exemplary embodiment, the image forming apparatus 100, which has received a conversion table generation instruction, passes 100 sheets 110 in a two-sided printing mode. In the two-sided printing mode, the sheets 110 pass the reversing unit 136 to preheat the conveyance guides near the color sensors 200. The two-sided printing mode is used because the discharged sheets 110 have higher temperatures than those in a one-sided printing mode. The two-sided printed sheets 110 are discharged in a reverse discharge mode. In other words, the sheets 110 are conveyed to the reversing unit 136 before reversed in the traveling direction and discharged reversed.

Through such control, the image forming apparatus 100 can generate conversion tables over a wide temperature range (from 80° C. to 25° C.). The two-sided printed sheets 110 may be left blank on both sides. The sheets 110 may be printed with solid black images on both sides. Since both sheets have the effect of increasing the temperature of the conveyance paths, the present exemplary embodiment is thus not limited to either of the sheets. The greater the amount of toner, the less the heat dissipates. The sheets printed with toner are thus generally more favorable than the blank sheets, whereas the toner is consumed accordingly. Which sheets to use may be selected as appropriate in view of the advantages and disadvantages.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims priority from Japanese Patent Application No. 2012-234025 filed Oct. 23, 2012, which is hereby incorporated by reference herein in its entirety.

What is claimed is:

1. An image forming apparatus comprising:

an image forming unit configured to form a measurement image on a sheet;

a fixing unit configured to heat the measurement image formed on the sheet to fix the measurement image to the sheet;

a measurement unit arranged downstream of the fixing unit in a conveyance direction of the sheet and configured to measure color of the measurement image fixed by the fixing unit;

a storage unit configured to store a plurality of pieces of conversion setting information each of which corresponds to one of a plurality of temperatures;

a selecting unit configured to select a piece of conversion setting information from among the plurality of pieces of conversion setting information;

a conversion unit configured to convert a measurement result of the measurement unit into a measurement result at a predetermined temperature based on the selected conversion setting information; and a control unit configured to cause the image forming unit to form the measurement image on the sheet, and cause the fixing unit to fix the formed measurement image onto the sheet, and wherein, when the sheet passed through the fixing unit is firstly conveyed to a measurement position, the control unit causes the measurement unit to measure a color of the measurement image and first measurement color data is obtained, after that, the control unit causes the measurement unit to measure a color of the measurement image under a condition that a temperature of the sheet is lower than the predetermined temperature, and second measurement color data is obtained; and a generation unit configured to generate conversion setting information based on the first and second measurement color data and store the generated conversion setting information in the storage unit.

2. The image forming apparatus according to claim 1, further comprising a temperature detection unit configured to detect a temperature of the sheet, wherein the conversion unit is configured to convert the measurement result of the measurement unit into a measurement result in an ordinary temperature environment by using the conversion setting information corresponding to the temperature detected by the temperature detection unit.

3. The image forming apparatus according to claim 1, further comprising a temperature calculation unit configured to calculate a temperature of the sheet, wherein the conversion unit is configured to convert the measurement result of the measurement unit into a measurement result in an ordinary temperature environment by using the conversion setting information corresponding to the temperature calculated by the temperature calculation unit.

4. The image forming apparatus according to claim 3, wherein the temperature calculation unit is configured to calculate the temperature of the sheet based on a type of the sheet.

5. The image forming apparatus according to claim 3, wherein the fixing unit includes a first fixing device and a second fixing device arranged downstream of the first fixing device, and wherein the temperature calculation unit is configured to calculate the temperature of the sheet based on whether to use both the first and second fixing devices or use either one of the first and second fixing devices.

6. The image forming apparatus according to claim 1, further comprising a preheating unit configured to preheat a conveyance path leading from the fixing unit to the measurement unit before the generation unit causes the measurement unit to measure the measurement image to generate the conversion setting information.

7. The image forming apparatus according to claim 6, wherein the preheating unit is configured to preheat the conveyance path leading from the fixing unit to the measurement unit by using heat of a sheet that has passed through the fixing unit.

8. The image forming apparatus according to claim 7, wherein the preheating unit is configured to preheat the conveyance path by setting a two-sided printing mode where images are formed on both sides of a sheet and a reverse discharge mode where the sheet is discharged reversed, and performing image formation.

9. The image forming apparatus according to claim 1, wherein the measurement unit is configured to measure an amount of light reflected from the measurement image in each wavelength range.

10. The image forming apparatus according to claim 1, further comprising a first calculation unit configured to calculate spectral reflectance of the measurement image based on the measurement result of the measurement image by the measurement unit.

11. The image forming apparatus according to claim 10, further comprising a second calculation unit configured to calculate a color value from the spectral reflectance.

12. The image forming apparatus according to claim 11, further comprising a second generation unit configured to generate a color correction table based on a calculation result of the second calculation unit.

13. The image forming apparatus according to claim 12, wherein the color correction table is an ICC (International Color Consortium) profile.

14. The image forming apparatus according to claim 13, further comprising a storage unit configured to store the ICC profile generated by the second generation unit.

15. The image forming apparatus according to claim 1, wherein the image forming unit is configured to form a monochromatic measurement image at a time of density measurement, and form a measurement image produced by superposing a plurality of colors at a time of color measurement.

16. The image forming apparatus according to claim 1, wherein the predetermined temperature is 25° C.

17. The image forming apparatus according to claim 1, wherein the setting unit is an operation unit configured to accept an operation input from a user.

18. The image forming apparatus according to claim 1, wherein the image forming unit is a unit configured to form the image by transferring toner to the sheet, and wherein the fixing unit is a unit configured to heat and fix the toner to the sheet.

19. The image forming apparatus according to claim 1, wherein the image forming unit is a unit configured to form the image on the sheet by discharging ink, and wherein the fixing unit is a drying unit configured to dry the ink.

* * * * *